US006207910B1

(12) United States Patent
Harvey et al.

(10) Patent No.: US 6,207,910 B1
(45) Date of Patent: Mar. 27, 2001

(54) LOW PROFILE, DOUBLE POLE SAFETY SWITCH AND CONNECTOR ASSEMBLY

(75) Inventors: Arthur James Harvey, Mantua; Mark R. Albrecht, Stow; Jan L. Michaud, Cuyahoga Falls; Michael Eric Liedtke, Massillon, all of OH (US)

(73) Assignee: Delta Systems, Inc., Streetsboro, OH (US)

( * ) Notice: Subject to any disclaimer, the term of this patent is extended or adjusted under 35 U.S.C. 154(b) by 0 days.

(21) Appl. No.: 09/347,656

(22) Filed: Jul. 6, 1999

(51) Int. Cl.[7] ..... H01R 13/703; H01H 13/52

(52) U.S. Cl. ..... 200/51.12; 200/16 R; 200/51.09; 200/85 A; 200/260

(58) Field of Search ..... 200/16 R–16 D, 200/51 R, 51.05, 51.06, 51.09, 51.11, 51.12, 85 R, 85 A, 520, 530, 531, 532, 536, 341, 260, 276

(56) References Cited

U.S. PATENT DOCUMENTS

| | | | | |
|---|---|---|---|---|
| 4,795,865 | * | 1/1989 | Howard | 200/85 A |
| 4,812,604 | * | 3/1989 | Howard | 200/260 |
| 4,885,438 | * | 12/1989 | Tajima | 200/51.09 |
| 4,894,019 | * | 1/1990 | Howard | 439/188 |
| 5,190,019 | | 3/1993 | Williams | 123/630 |
| 5,424,502 | | 6/1995 | Williams | 200/85 A |
| 5,613,598 | * | 3/1997 | Pittman et al. | 200/295 |
| 5,775,482 | * | 7/1998 | Wolfe et al. | 200/296 |

OTHER PUBLICATIONS

Six pages from a 1999 catalog published by Delta Systems, Inc. of Streetsboro, Ohio showing and describing specifications of Delta Systems, Inc. plunger switches identified as part Nos. 6400, 6440 and 6700. to best of Applicants' knowledge, the plunger switches identified as part Nos. 6400, 6400 and 6700 were on sale more than one year prior to the filing date of the present application.

Three pages of drawings dated Jun. 10, 1999, Jun. 5, 1992 and Jun. 8, 1992, showing plunger switches identified as part Nos. 6400, 6440 and 6700 of Delta Systems, Inc. of Streetsboro, Ohio. To best of Applicants' knowledge, the drawings were distributed to customers of Delta Systems, Inc. more than one year prior to the filing date of the present application.

* cited by examiner

*Primary Examiner*—Michael Friedhofer
(74) *Attorney, Agent, or Firm*—Watts, Hoffmann, Fisher & Heinke, Co., L.P.A.

(57) ABSTRACT

A low profile, two pole, plunger-type safety switch and connector assembly includes a switch housing and switch components are supported within the housing interior region. An actuator extends exteriorly though the housing opening and is moveable along a linear path of travel between two positions, one position of the actuator corresponding to an undepressed position and a second position of the actuator corresponding to a depressed position. Terminals of the switch assembly terminate in conductive male contacts extending through a side wall of the switch housing substantially perpendicular to the path of travel of the actuator. The connector assembly includes a connector housing supporting four female terminals sized to snugly receive respective different ones of the four male contacts when the connector housing engages the switch housing. Extending arms of a flexible, electrically conductive shorting member contact a center two of the female terminals. When the connector is engaged with the switch housing a pair of beveled triangular shaped nubs extending from the switch housing contacts the shorting member arms and deflects them away from contact with the female terminals. When the connector is not engaged with the switch housing, the shorting member arms contact the two center female terminals creating a closed circuit condition in a circuit that the female terminals are electrically coupled to.

25 Claims, 8 Drawing Sheets

LOW PROFILE, DOUBLE POLE SAFETY SWITCH AND CONNECTOR ASSEMBLY

FIELD OF THE INVENTION

The present invention relates generally to a low profile, double pole safety switch and connector assembly and, more particularly, to a double pole, plunger-type safety switch and an engaging connector assembly wherein a height of the safety switch and connector assembly along a axis defined by the path of travel of the switch actuator is minimized and further wherein the connector assembly includes a shorting member to short at least one of the two circuits upon disengagement of the connector assembly from the safety switch housing.

BACKGROUND OF THE INVENTION

Plunger switches are widely utilized in many diverse applications including use as safety switches in various motorized devices. For example, U.S. Pat. Nos. 5,424,502, issued Jul. 27, 1993 to Williams, entitled QUICK-INSTALL SEAT SWITCH and assigned to the assignee of the present invention discloses a plunger switch and quick install mounting assembly for mounting the plunger switch on a rigid seat pan of a garden or lawn tractor. The '502 patent is incorporated herein in its entirety by reference. The switch assembly disclosed in the '502 patent is a single pole plunger switch that is a switch with two terminal contacts, the plunger switch electrically coupling or decoupling the two terminals depending upon the plunger or actuator position. The mounting assembly of the '502 patent affixed the plunger switch to the seat pan such that the actuator extends above the seat pan and the switch housing was below the seat pan.

A cover overlies the actuator. When the operator is seated on the seat cushion, the cover is forced downward by the deflection of the seat cushion thereby depressing the actuator from its first undepressed position to a second depressed position. If the switch assembly was a normally closed switch (i.e., the terminals were electrically coupled with the actuator was in its first undepressed position) and the switch assembly terminals were electrically coupled between the tractor engine magneto and an electrical ground of the tractor, the tractor engine would be shut off whenever the operator stepped (or fell) off of the tractor seat. That is, actuator would return to its first undepressed position thereby closing the electrical connection between the magneto and electrical ground resulting in the magneto being grounded out and stalling the engine.

With additional switches and/or relays appropriately mounted and connected, more sophisticated safety functions could be accomplished, for example, shutting off the engine only if the operator was not sitting on the seat and the tractor's mowing blade and/or power take off was engaged. U.S. Pat. No. 5,190,019, issued Mar. 2, 1993 and entitled INTERLOCK CIRCUIT FOR DE-ACTIVATING AN ENGINE, also assigned to the assignee of the present invention discloses such a circuit. The '019 patent is incorporated in its entirety by reference. Once again, a single pole seat mounted safety switch was contemplated.

While the tractor seat pan mounted plunger-type safety switch disclosed in the '502 patent provided a securely mounted switch that was easy to mount, such a switch (and other such prior art seat mounted safety switches) provided only a single circuit (one pole) switch. With the desire for additional operational fail-safe safety functions on lawn and garden tractors and riding lawn mowers such as turning the engine off if the cutting blade is engaged and the tractor is shifted into reverse, there is a need for a safety switch having more than one pole, thereby avoiding the necessity of duplicate switches and/or relays. Further, because of limited mounting room below the seat pan, it is desirable that the switch housing and connector be configured to minimize the height of the assembly extending below the seat pan, that is, along an axis of movement of the actuator. Additionally, it is desirable to prevent an operator from bypassing the operation of the safety functions provided by a seat mounted safety switch by simply disengaging the connector coupled to the switch housing.

SUMMARY OF THE INVENTION

The present invention concerns a low profile, two pole, safety switch and connector assembly. The assembly includes a plunger type switch assembly and a connector assembly. The switch assembly includes a switch housing defining an opening through which a plunger or actuator extends and an interior region supporting switch components. The actuator is moveable along a path of travel between two positions, one position of the actuator corresponding to an undepressed position and a second position of the actuator corresponding to a fully depressed position. First and second spaced apart V-shaped contacts are mounted on a support or boss extending from the actuator and move with the actuator. Positioned along a path of travel of the first contact are first and second terminals. In one of the two actuator positions, the first and second terminals are bridged by the first contact and in the other of the two actuator positions, the first and second terminals are not bridged by the first contact. Positioned along a path of travel of the second contact are third and fourth terminals, in one of the two actuator positions, the third and fourth terminals are bridged by the second contact and in the other of the two actuator positions, the third and fourth terminals are not bridged by the second contact.

The terminals include extending portions that extend through spaced apart openings in a side wall of the switch housing thereby minimizing the effective vertical height of the switch assembly. The terminal extending portions are substantially perpendicular to the path of travel of the actuator and are sized to receive female terminals or sockets supported by the connector assembly. The connector assembly includes four female terminals that are sized and aligned to snugly receive respective different ones of the four terminal extending portions when the connector engages the plunger housing extension.

Extending arms of a flexible, electrically conductive shorting member contact a center two of the female terminals. When the connector is engaged with the plunger housing a pair of beveled, triangular shaped nubs extending from a bottom cover of the housing contacts the shorting member arms and deflects them away from contact with the female terminals. When the connector housing is not engaged with the switch housing, the shorting member arms contact the center two female terminals and the shorting member create a closed circuit condition in a circuit that the female terminals are electrically coupled to. This prevents bypassing the function of the safety switch by simply disconnecting the connector housing from the switch housing, e.g., an operator being able to start or run the tractor without sitting in the seat by simply disconnecting the connector housing from the switch housing.

These and other objects, features and advantages of the invention will become better understood from the detailed description of the preferred embodiments of the invention which are described in conjunction with the accompanying drawings.

DETAILED DESCRIPTION

Figure 1:
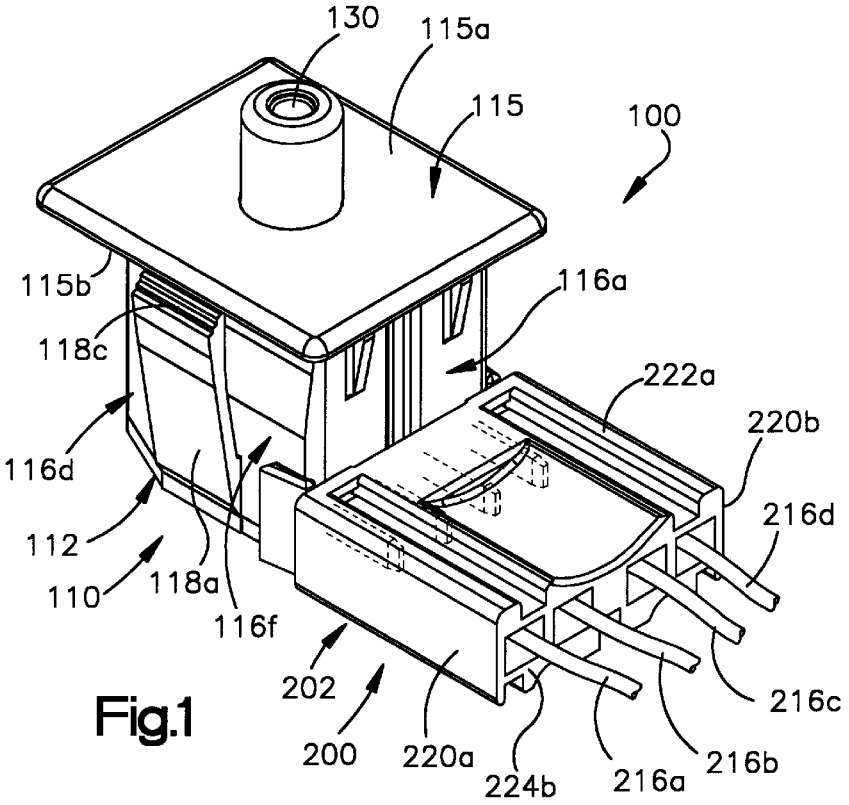
FIG. 1 is a perspective view of the two pole plunger-type safety switch and connector assembly of the present invention including a switch assembly and a connector assembly.
Figure 2:
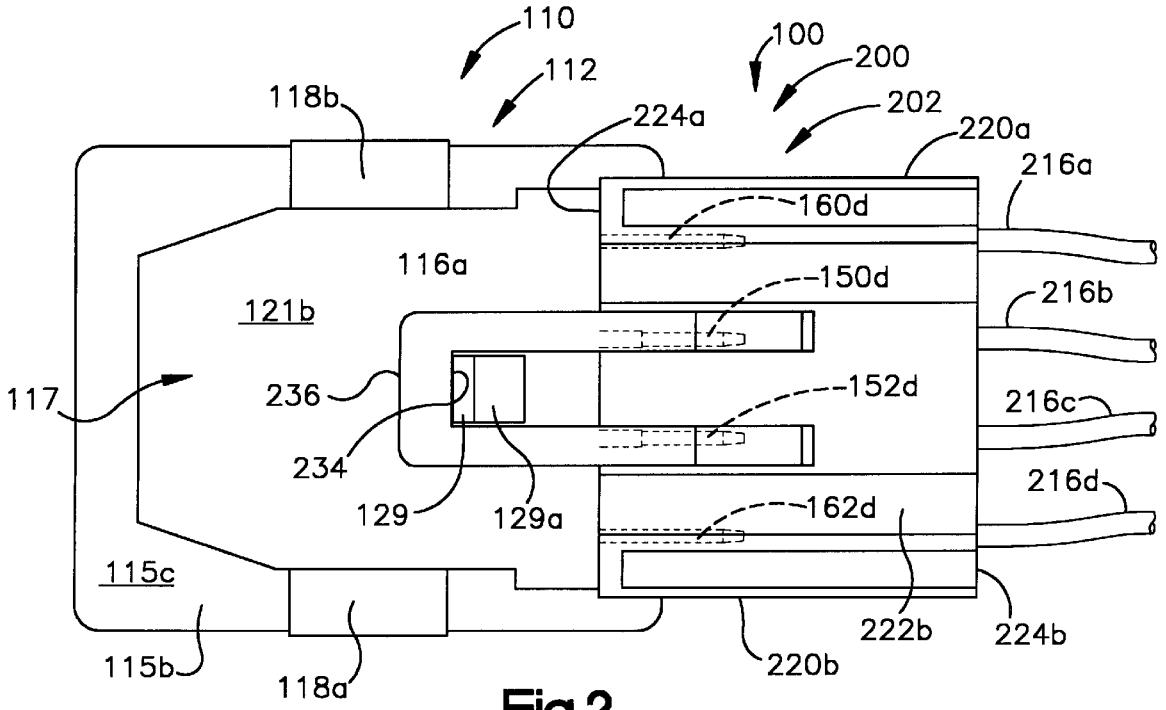
FIG. 2 is a bottom plan view of the switch and connector assembly of FIG. 1.

Turning to the drawings, a low profile, two pole, plunger-type safety switch and connector assembly of the present invention is shown generally at 100 in FIG. 1. The assembly 100 includes a switch assembly 110 and a connector assembly 200. The switch assembly 100 includes a switch housing 112 supporting switch components 114 and the connector assembly 200 includes a connector housing 202 supporting connector components 203. The connector housing 202 is configured to releasably engage the switch housing 112.

Figure 6:
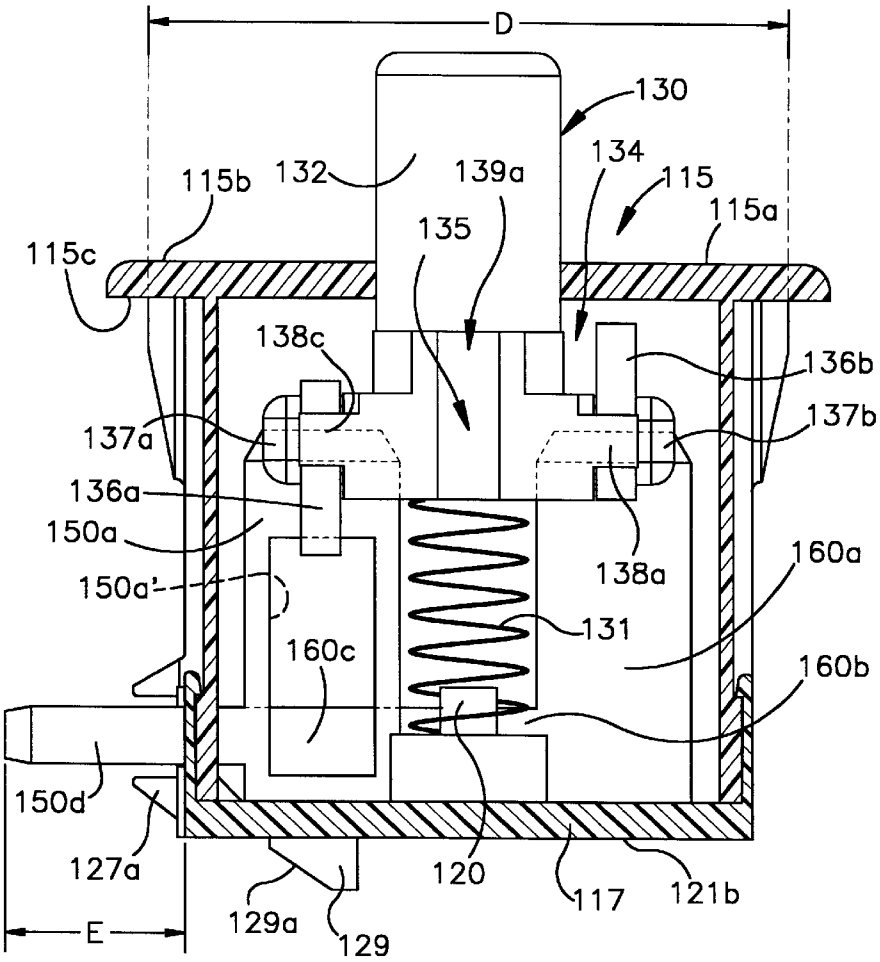
FIG. 6 is a sectional view of the switch assembly as seen from a plane indicated by the line 6—6 in FIG. 5.
Figure 5:
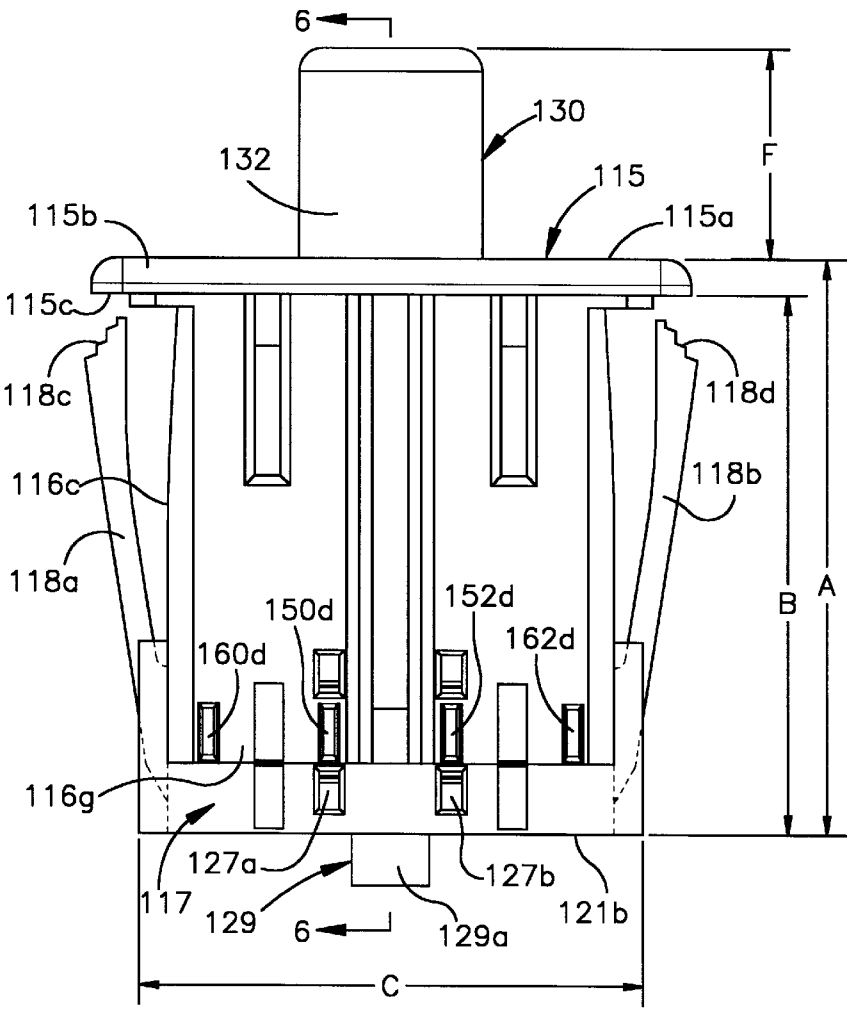
FIG. 5 is a front elevation view of the switch assembly.
Figure 8:
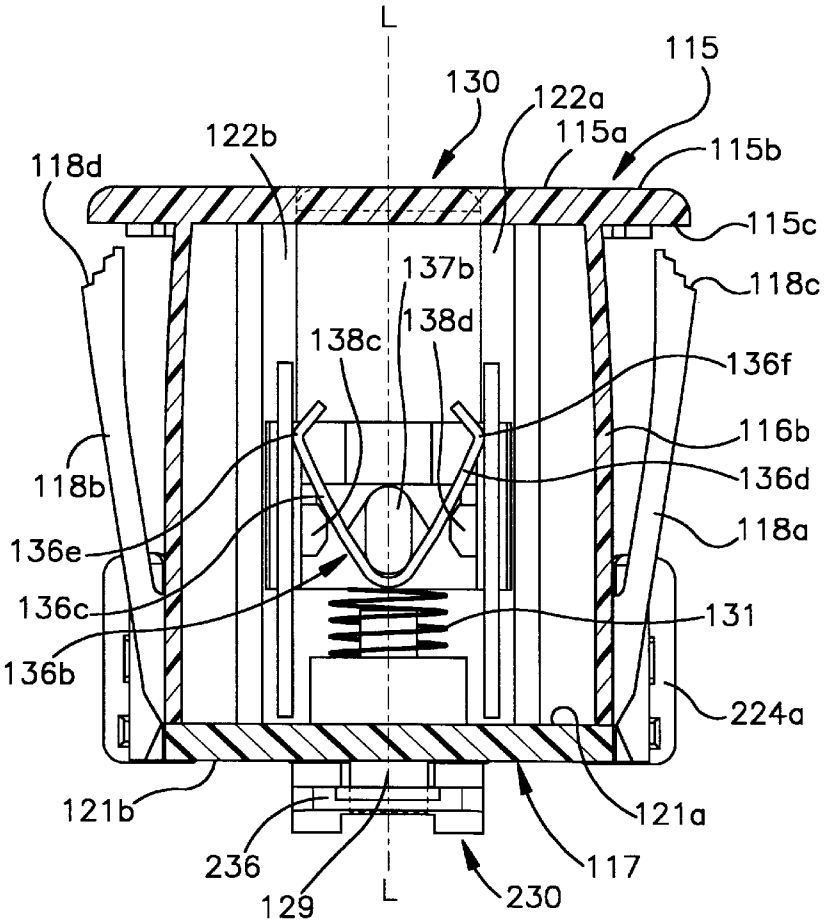
FIG. 8 is the sectional view of FIG. 7 with the actuator of the switch assembly being in a second, depressed position.
Figure 7:
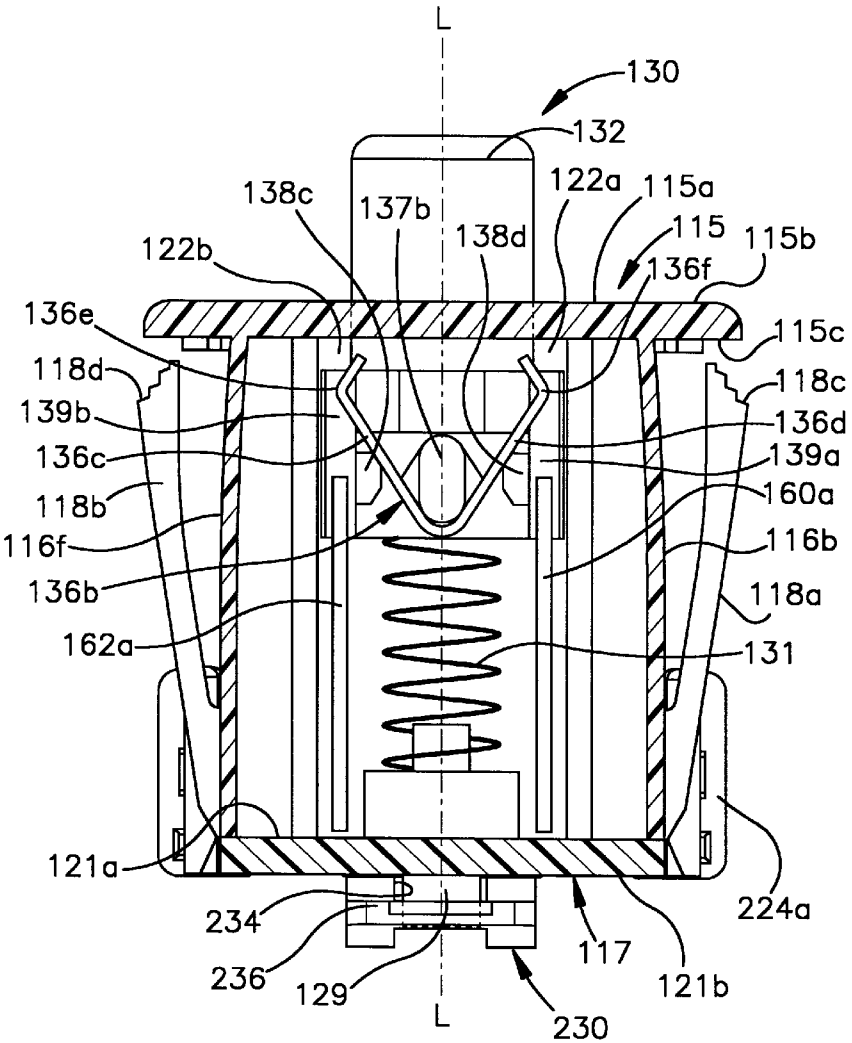
FIG. 7 is another sectional view of the switch assembly with an actuator of the switch assembly being in a first, undepressed position.

The switch assembly 110 is a two pole, plunger-type switch that includes a plunger or actuator 130 supported for longitudinal movement between a first, undepressed position and a second, depressed position along the axis labeled L—L in FIGS. 7 and 8. The switch housing 112 and the connector housing 202 are both fabricated of a rugged, nonconductive material such as polypropylene. The switch and connector assembly 100 includes two poles, that is, two independent switches, each of which may be coupled to an independent circuit. The switch and connector assembly 100 is low profile in that the connector housing 202 engages a front wall 116*a* of the switch housing 112 perpendicular to the path of travel of the actuator 130 and the switch components 114 are configured so that the vertical height of the assembly 100 as measured along the longitudinal axis L—L of the actuator patch of travel is minimized. A low profile switch and connector assembly is highly desirable when there is limited space for the vertical height of the assembly. Not including the actuator 130 which extends above a top wall 115 of the switch housing 112, the height of the assembly is approximately 1.04 inches. The actuator 130, in its first position, extends approximately 0.4 inch above an upper surface 115*a* of the top wall 115 of the switch housing 112. Suitable dimensions for the assembly 100, as labeled in FIGS. 5 and 6, are as follows:

| Description | Label | Dimension |
|---|---|---|
| Switch housing height | A | 1.10 inches |
| Switch housing height (not including thickness of top wall 115) | B | 1.03 inches |
| Switch housing width (not including width of top wall 115) | C | 1.01 inches |
| Switch housing depth | D | 1.24 inches |
| Terminal length extending exteriorly of front wall 116a | E | 0.34 inch |
| Height of actuator 130 above upper surface 115a of top wall 115 when actuator is in first position | F | 0.41 inch |
| Connector housing height | | 0.40 inch |
| Connector housing width | | 1.10 inches |
| Connector housing depth | | 0.99 inch |

Figure 16:
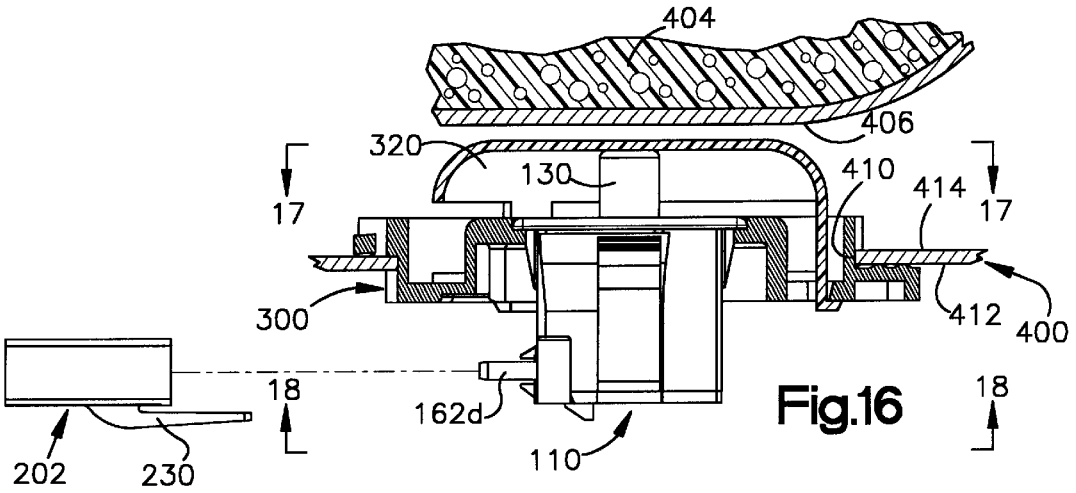
FIG. 16 is a view partly in elevation and partly in section of the switch assembly of the present invention mounted to a seat pan of a garden tractor.
Figure 17:
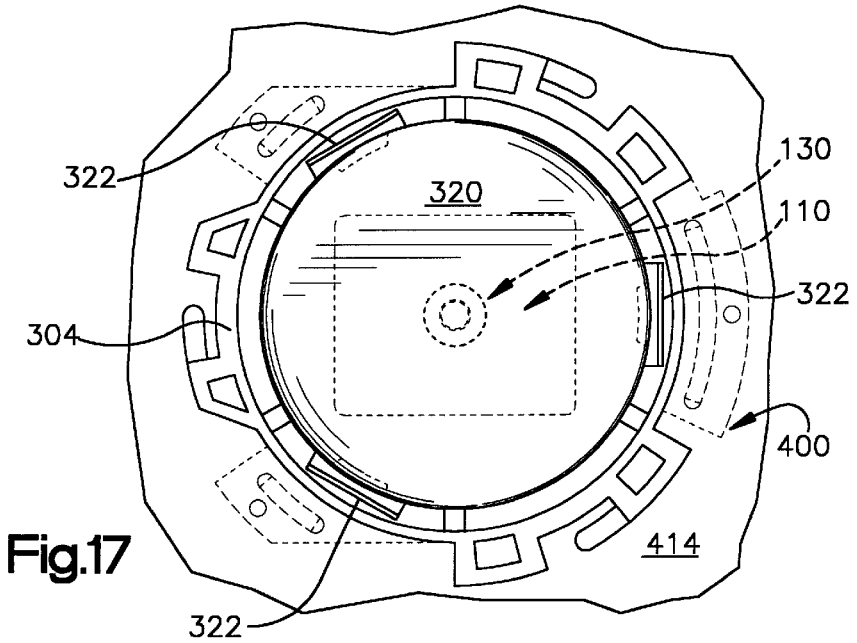
FIG. 17 is a top elevation view of the switch assembly mounted to the garden tractor seat pan shown in FIG. 16.
Figure 18:
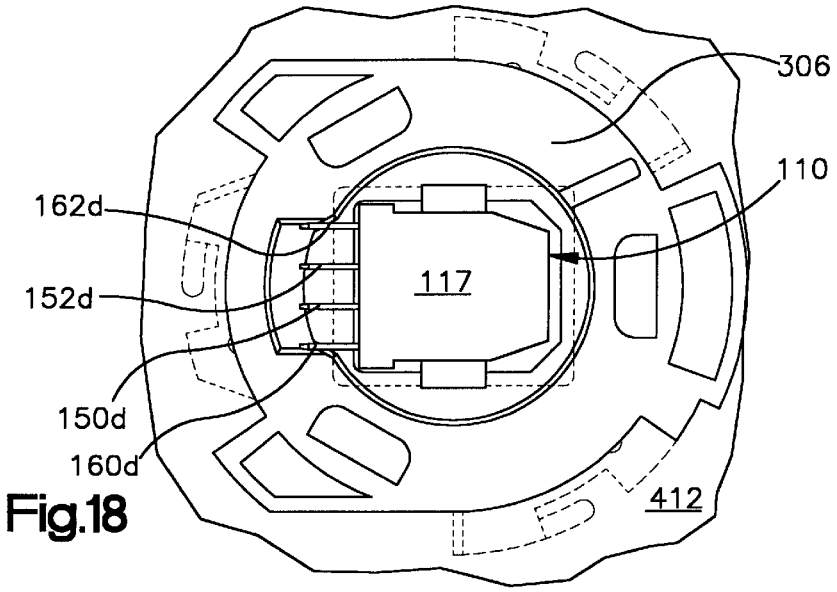
FIG. 18 is a bottom elevation view of the switch assembly mounted to the garden seat pan shown in FIG. 16.

A typical use of the assembly 100 is shown in FIGS. 16, 17 and 18 wherein the switch housing 112 is mounted to a rigid, metal seat pan 400 of a garden or lawn tractor. The seat of the tractor includes the seat pan 400 and a pliable cushion 404. When an operator is not seated on the cushion 404, the cushion defines a generally concave lower surface 406 spaced from the seat pan 400.

The switch housing 112 is sized to be received in an opening of a support member 300. A lower portion of the switch housing 112 extends below a lower portion of the support member 306. A suitable support member is disclosed in U.S. Pat. No. 5,424,502, referenced above. An outer wall 302 of an upper portion 304 of the support member 300 is sized to be inserted through a cutout 410 in the seat pan 400 when the support member 300 is in a particular orientation with respect to the seat pan cutout. When the support member upper portion 304 is inserted through the cutout 410, the lower portion 306 of the support member 300 abuts a lower surface 412 of the seat pan 400. A gap between the support member upper and lower portions 304, 306 is slightly greater than a thickness of the seat pan 400. After inserting the lower portion 306 of the support member 300 through the seat pan cutout 410, the support member 300 is rotated with respect to the seat pan 400 to lock the support member 300 into a fixed position with respect to the seat pan 400. In the locked position of the support member, three downwardly extending arms of the upper portion 304 are received in respective apertures in the seat pan 400.

A switch cover 320 overlies the actuator 130. The switch cover 320 and an upper portion 122 of actuator 120 extend above an upper surface 414 of the seat pan 400. Integral with the cover 320 are three equally spaced flexible and resilient legs 322 that connect the cover to the support member 300. Extending between the legs 322 is a peripheral edge. As the operator sits on the seat cushion 404, the cushion contacts the cover 320 forcing the peripheral edge of the cover into contact with the support member 300. Movement of the cover 320 downwardly resulting from an operator sitting on the cushion 404 causes the actuator 130 to move from a first outwardly extending, undepressed position to a second, depressed position (the two positions of the actuator 130 are shown in FIGS. 7 and 8). The path of travel of the actuator 130 between its first and second positions is about 0.4 inch.

One skilled in the art will appreciate that while the safety switch and connector assembly 100 of the present invention is suitable for use in various applications where a low profile, double pole, plunger-type safety switch is required, the use of the assembly 100 is not limited to installation in seat pans of lawn and garden tractors or riding lawn mowers.

Switch Assembly 110

The switch assembly 110 includes the switch housing 112 and switch components 114 supported within an interior region of the switch housing 112. The switch housing 112 includes a top wall 115, side walls 116*a*, 116*b*, 116*c*, 116*d*, 116*e*, 116*f* integral with the top wall 115 and a bottom cover 117 affixed to the side walls, preferably by ultrasonic welding.

The top wall 115 includes an ⅜ inch diameter opening through which the actuator upper portion 132 extends and also includes peripheral portions 115*a* that extend beyond the side walls 116*a*, 116*b*, 116*c*, 116*d*, 116*e*, 116*f*. The side walls 116*b* and 116*f* include upwardly extending flexible wings 118*a*, 118*b*. The wings 118*a*, 118*b* have stepped upper surfaces to accommodate being secured to panels or other supports have any of three different thickness, 0.060 inch, 0.085 inch and 0.105 inch. The switch housing 112 may be secured to, for example, a panel or other support (such as the support member 300) having a suitable thickness and an appropriate sized cutout, that is, a cutout of size and shape into which the switch housing side walls will just fit into. Portions of the peripheral region defining the cutout will be sandwiched between upper portions 118*c*, 118*d* of the wings 118*a*, 118*b* and a bottom surface 115*c* of the overhanging portions 115*b* of the top wall 115 to secure the switch housing in place vertically (that is, along the longitudinal axis L—L) while the snug fit between the peripheral region defining the cutout and the side walls will prevent movement of the switch housing in directions perpendicular to axis L—L.

The switch components 114 include the actuator 130 and a coil spring 131 between a vertical opening 133 extending upwardly into a lower portion 134 of the actuator 130 and a post 120 extending upwardly from an inner surface 121 of the bottom cover 117 for biasing the actuator 130 to its first, undepressed position. The lower portion 134 of the actuator includes a boss 135 supporting a pair of spaced apart V-shaped contacts 136*a*, 136*b*. Each of the V-shaped contacts 136*a*, 136*b* is secured at opposite ends of the boss 135 between three horizontally extending posts, namely, a center post 137*a* and two outer posts 138*a*, 138*b*, flanking the center post 137*a* and a center post 137*b* and two flanking outer posts 138*c*, 138*d*. The posts 137*a*, 137*b*, 138*a*, 138*b*, 138*c*, 138*d* are configured such that the contacts 136*a*, 136*b* may selectively be oriented in two position, i.e., 1) the leg portions 136*c*, 136*d* of the contacts extending upwardly toward the upper wall 115 (as is the orientation of the contact 136*b*); or 2) the leg portions 136*c*, 136*d* of the contacts extending downwardly toward the bottom cover 117 (as is the orientation of the contact 136*a*). The leg portions 136*c*, 136*d* of the contacts 136*a*, 136*b* have to be squeezed together slightly to be inserted over a center post and between the two flanking outer posts, when the leg portions are released, the contact is firmly affixed to the boss 135 in the desired orientation.

Figure 13:
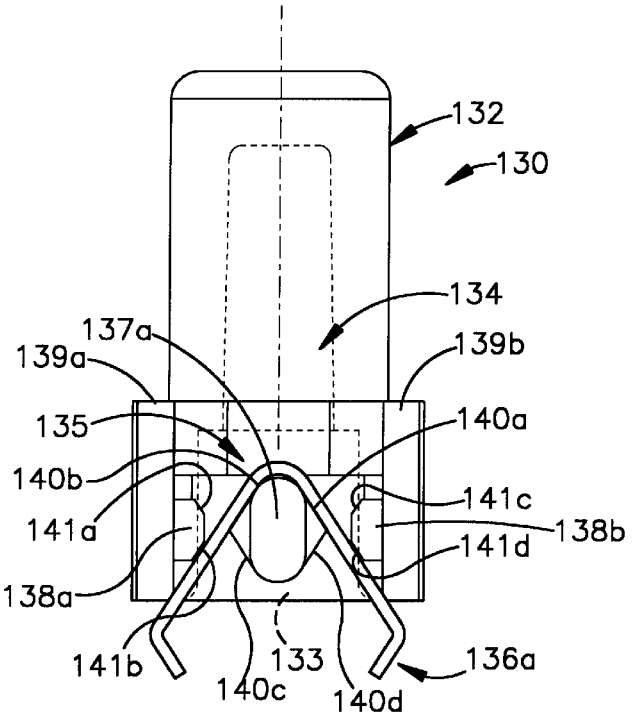
FIG. 13 is a front elevation view of the actuator of the switch assembly.

The orientation of a contact is dependent on the type of switch is desired, that is, whether a normally open switch or a normally closed switch is desired. If a normally open switch is desired a contact's leg portions will be oriented upwardly (like contact 136*b*), while if a normally closed switch is desired a contact's leg portions will be oriented downwardly (like contact 136*a*). In a normally open switch, with the actuator 130 in its first, undepressed position, the contact will not bridge or electrically couple its respective terminal pair. In a normally closed switch, with the actuator 130 in its first position, the contact will bridge or electrically couple its respective terminal pair. To facilitate dual contact orientations, as can best be seen in FIGS. 4 and 13, the boss center post 137*a* includes flat support surfaces 140*a*, 140*b* angled at approximately 33 degrees with respect to the vertical axis L—L forming a triangular shaped support. Similarly, the boss side posts 138*a*, 138*b* similarly include flat support surfaces 141*a*, 141*b* (FIG. 13) angled at approximately 33 degrees with respect to the vertical axis L—L forming truncated triangular shaped supports. The same configuration is true for center posts 137*b* and flanking side posts 138*c*, 138*d*.

Vertically oriented guides 139*a*, 139*b* of the boss 135 slide within vertical rectangular shaped channels 122*a*, 122*b* formed in a pair of vertical supports 180*a*, 180*b* which extend inwardly from respective side walls 116*b*, 116*f* Additionally, the boss center posts 137*a*, 137*b* slide within vertical, semicircular shaped channels 194*a*, 194*b* in a vertical support 187 extending rearwardly from the front wall 116*a* and a vertical support 190 extending frontwardly from the back wall 116*d*. The boss guides 139*a*, 139*b* and housing channels 122*a*, 122*b* cooperate to prevent rotation or misalignment of the actuator 130 as it moves along its path of travel between its first and second positions.

A first set of two inner terminals 150, 152 and the contact 136*a* form a normally closed switch, that is, in the first, undepressed actuator position, the terminals 150, 152 are bridged by the contact 136*a* and in the second, depressed actuator position, the terminals 150, 152 are not bridged by the contact 136*a*. The terminals 150, 152 include contact portions 150*a*, 152*a*, angled portions 150*b*, 152*b*, and exterior extending portions 150*d*, 152*d* (which extend exteriorly of the switch housing 112). The contact portions 150*a*, 152*a* extend in the direction of the axis L—L, the path of travel of the actuator 130.

The angled portions 150*b*, 152*b* and the extending portions 150*d*, 152*d* extend substantially orthogonally to the contact portions 150*a*, 152*a*. The extending portions 150*d*, 152*d* are offset from the contact portions 150*a*, 152*a* by the inwardly extending angled portions 150*b*, 152*b*. The offset of the contact and exteriorly extending ports can best be seen in FIG. 9.

The extending portions 150*d*, 152*d* extend through an inner two of the four slotted openings 128*b*, 128*c* adjacent a bottom edge 116*g* of the front wall 116*a*. Note that there are rectangular openings 150*a*', 150*a*' (FIG. 4) in contact portions 150*a*, 152*a* of the terminals 150, 152. In the first position of the actuator 130, the terminal contact surfaces 136*e*, 136*f* of the downwardly extending legs 136*c*, 136*d* of the contact 136*a* engage the contact portions 150*a*, 152*a* just above the openings 150*a*', 150*a*' thereby electrically connecting or bridging the terminals 150, 152. In the second position of the actuator 130, the contact 136*a* moves downwardly such that the downwardly extending legs 136*c*, 136*d* of the contact 136*a* are within the rectangular openings 150*a*', 150*a*' and do not touch the contact portions 150*a*, 152*a*, thus, in the second position of the actuator 130 there is no electrical connection between the terminals 150, 152.

A second set of two outer terminals 160, 162 and the contact 136*b* form a normally open switch, that is, as can be seen in FIG. 7 in the first, undepressed actuator position, the terminals 160, 162 are not bridged by the contact 136*b* and in the second, depressed actuator position, as can be seen in FIG. 8, the terminals 160, 162 are bridged by the contact 136*b*. The terminals 160, 162 include contact portions 160*a*, 162*a*, angled portions 160*b*, 162*b*, interior extending portions 160*c*, 162*c*, which extend within the housing interior region 113, and exterior extending portions 160*d*, 162*d*, which extend through the slotted openings 128*a*, 128*d* in the switch housing front wall 116*a* and protrude exteriorly of the switch housing 112. The contact portions 160*a*, 162*a* extend in the direction of the axis L—L, the path of travel of the actuator 130. The angled portions 160*b*, 162*b* and the interior and exterior extending portions 160*c*, 160*d*, 162*c*, 162*d* extend substantially orthogonally to the contact portions 160*a*, 162*a*.

Figure 9:
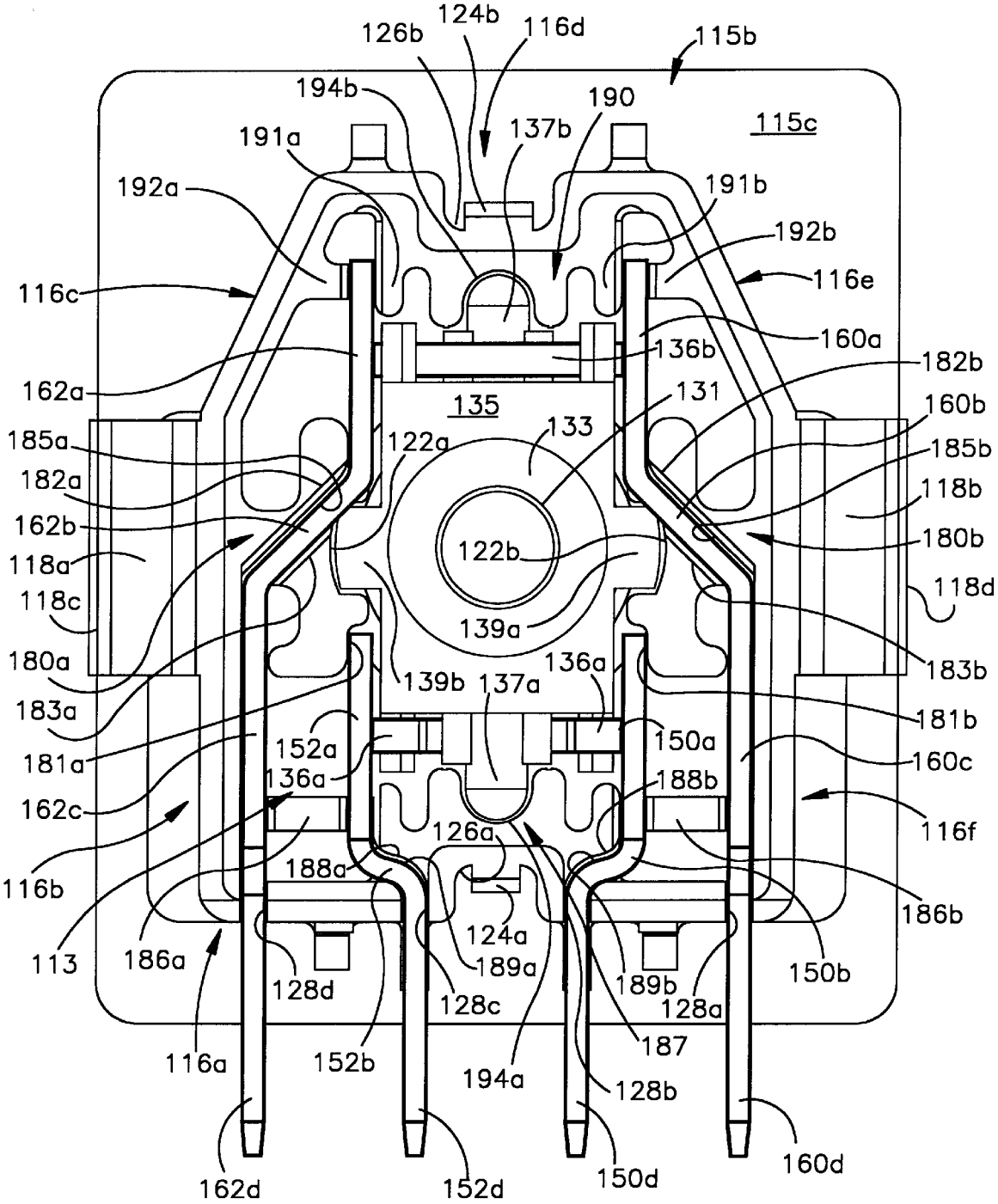
FIG. 9 is a bottom plan view of the switch assembly with a bottom cover removed.
Figure 10:
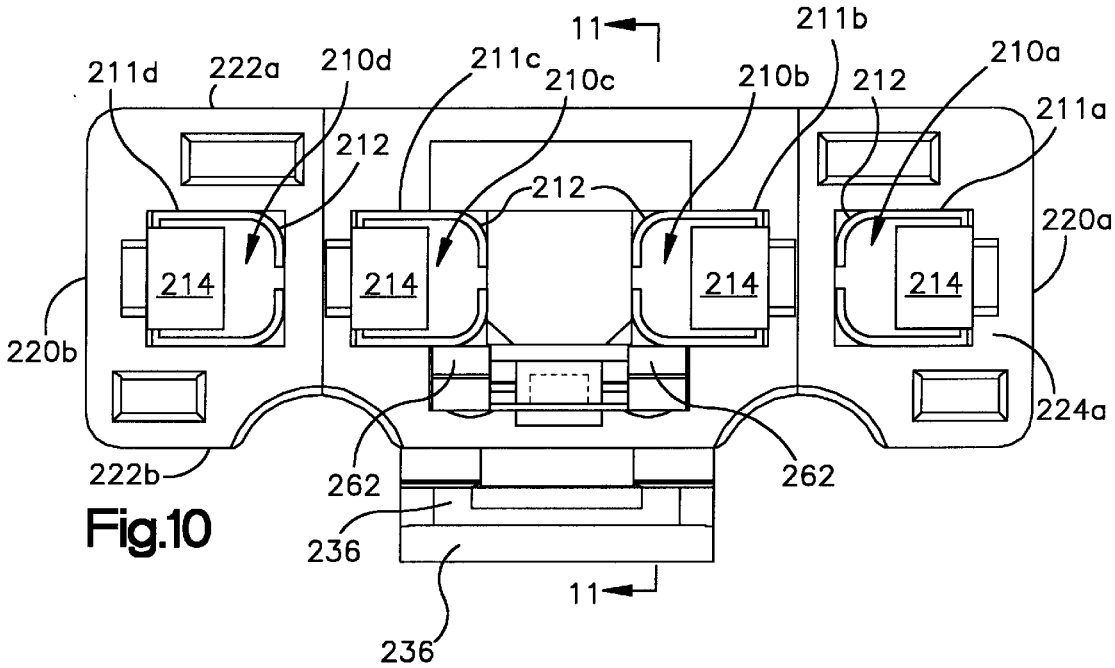
FIG. 10 is a front elevation view of the connector assembly.

As can best be seen in FIG. 9, the interior extending portions 160*c*, 162*c* are offset from the contact portions 160*a*, 162*a* by the outwardly extending angled portions 160*b*, 162*b*. The exterior extending portions 160*d*, 162*d* are smaller or are necked down from the interior extending portions such that the exterior extending portions 150*d*, 152*d*, 160*d*, 162*d* of all of the terminals are of equal size and equal spaced. Note that there are no rectangular openings in the contact portions 160*a*, 162*a* of the terminals 160, 162 because they are normally open terminals as opposed to the normally closed terminals 150, 152. In the first position of the actuator 130, the terminal contact surfaces 136*e*, 136*f* of the upwardly extending legs 136*c*, 136*d* of the contact 136*b* do not touch the contact portions 160*a*, 162*a*, thus, there is no electrical connection between the terminals 152, 162. In the second position of the actuator 130, the terminal contract surfaces 136*e*, 136*f* of the leg 136*c*, 136*d* of the contact 136*b* move downwardly and contact the contact portions 152*a*, 162*a* thereby electrically connecting the terminals 152, 162.

Figure 14:
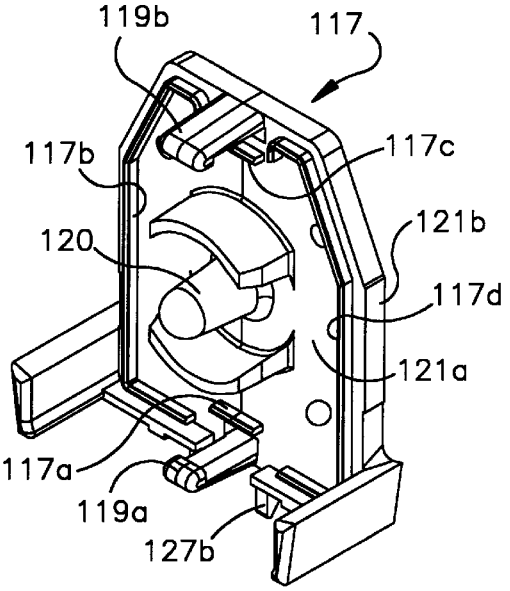
FIG. 14 is a perspective view of a bottom housing cover of the switch assembly housing.

As can best be seen in FIG. 9, which is a bottom plan view of the switch housing 112 with the bottom cover 117 removed, the contact portions 150*a*, 152*a* of the first set of inner terminals 150, 152 are positioned closer to the switch housing front wall 116*a*, while the contact portions 160*a*, 162*a* of the second set of outer terminals 160, 162 are aligned with the contact portions 150*a*, 152*a*, but are positioned closer to the switch housing back wall 116*d*. The switch housing 112 includes a set of vertical supports and terminal support surfaces to support the inner and outer sets of terminals in an upright, spaced apart positions within the housing interior region such that the extending portions of the terminals exit through equally spaced apart slots 128*a*, 128*b*, 128*c*, 128*d* in the front wall 116*a*. The vertical supports and terminal support surfaces also facilitate assembly of the terminals within the switch housing, the terminals being inserted into the switch housing with the bottom cover removed. After the terminals 150, 152, 160, 162 are positioned in the switch housing interior region 113, the coil spring 131 is inserted in the actuator opening and the bottom cover is aligned with the housing, the coil spring 131 aligned with the bottom cover post 120 and the cover 117 is snapped into place, the inwardly extending edges of latches 119*a*, 119*b* (seen in FIGS. 4, 5 and 14) snap over upper portions of rectangular nubs 124*a*, 124*b* which extend outwardly from vertical recessed channels 126*a*, 126*b* of the front wall 116*a* and the back wall 116*d*. The snap fit of the cover 117 onto the switch housing 112 holds the switch components 114 in place and thus facilitates ultrasonic welding of the cover 117 to the switch housing 112. Raised upwardly extending ridge portions 117*a*, 117*b*, 117*c*, 117*d* located inwardly from the outer periphery of the cover 117 abut corresponding recessed stepped portions located inwardly from the side walls 116*a*, 116*b*, 116*c*, 116*d*, 116*e*, 116*f* of the switch housing 112 to provide an improved fit and seal between the cover 117 and the switch housing 112.

The terminal supports in the switch housing interior region 113 include the pair of vertical supports 180*a*, 180*b* which extend inwardly from respective side walls 116*b*, 116*f*. *The vertical supports 180a*, 180*b* define forward edges 181*a*, 181*b* which abut and helps locate rearward portions of the contacting members 150*a*, 152*b* of the inner terminal set 150, 152. The vertical supports 180*a*, 180*b* also define edges 182*a*, 182*b*, 183*a*, 183*b*, 184*a*, 184*b* which abut and help locate the angled portions 160*b*, 162*b* of the outer terminal set 160, 162. Additionally, the vertical supports 180*a*, 180*b* includes respective recessed passageways 185*a*, 185*b* through which the angled portions 160*b*, 162*b* extend. An upper surface of the angled portions 160*b*, 162*b* are supported on flat portions of the vertical supports 180*a*, 180*b* defining the recessed passageways 185*a*, 185*b*.

A pair of vertical outer supports 186*a*, 186*b* in housing interior region 113 abut and help locate frontward portions of the contact portions 150*b*, 152*b* of the inner terminal set 150, 152. The vertical center support 187 extends rearwardly from the front wall 116*a* of the housing 112. Outer edges 188*a*, 188*b* of the vertical center support 187 abut and help locate the frontward portions of the contact portion 150*a*, 152*a* and the angled portions 150*b*, 152*b* of the inner terminal set 150, 152. Additionally, the vertical support 187 includes a recessed passageways 189*a*, 189*b* through which the angled portions 150*b*, 152*b* of the inner terminals 150, 152 extend. An upper surface of the angled portions 150*b*, 152*b* are supported on flat portions of the vertical support 187 defining the recessed passageways 189*a*, 189*b*.

The terminal supports in the switch housing interior region 113 further include a vertical center support 190 extending frontwardly from the back wall 116*d*. The vertical center support 190 includes outer edges 191*a*, 191*b* which abut and help locate the rearward portions of the contact portions 160*a*, 162*a* of the outer terminal set 160, 162. A pair of vertical outer supports 192*a*, 192*b* extending inwardly from the angled side walls 116*c*, 116*e* abut and help locate rearward portions of the contact portions 160*a*, 162*b* of the outer terminal set 160, 162.

Connector Assembly 200

The connector assembly 200 includes the housing 202, also preferably fabricated of polypropylene, which supports a linear alignment of four female terminal or socket assemblies 210*a*, 210*b*, 210*c*, 210*d* disposed in respective spaced apart horizontal channels 211*a*, 211*b*, 211*c*, 211*d* extending through the connector housing 202 between the front and back walls 224*a*, 224*b*. Each terminal assembly 210*a*, 210*b*, 210*c*, 210*d* includes a terminal 212 having a V-shaped spring member 214 and is connected to a conductive lead 216*a*, 216*b*, 216*c*, 216*d* extending from the connector housing 202 through horizontal channels 221*a*, 221*b*, 221*c*, 221*d*.

When the connector housing 202 and switch housing 112 are engaged, the exterior extending portions 150*d*, 152*d*, 160*d*, 162*d* of the terminals 150, 152, 160, 162 are wedged between a cylindrical interior wall and an extending leg of the V-shaped spring member 214 thereby insuring positive electrical contact between the terminal extending portion 160*d* and the terminal assembly 210a, the terminal extending portion 150d and the terminal assembly 210*b*, the terminal extending portion 152*d* and the terminal assembly 210*c*, and the terminal extending portion 162*d* and the terminal assembly 210*d*.

Figure 11:
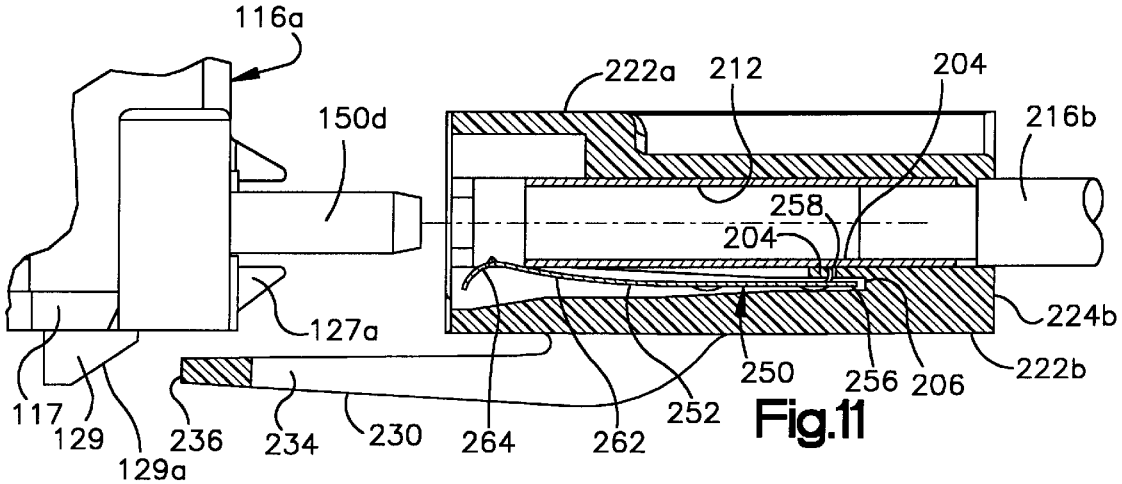
FIG. 11 is a sectional view of the connector assembly as seen from a plane indicated by the line 11—11 in FIG. 10 and prior to engagement of the connector housing and the switch assembly housing.
Figure 12:
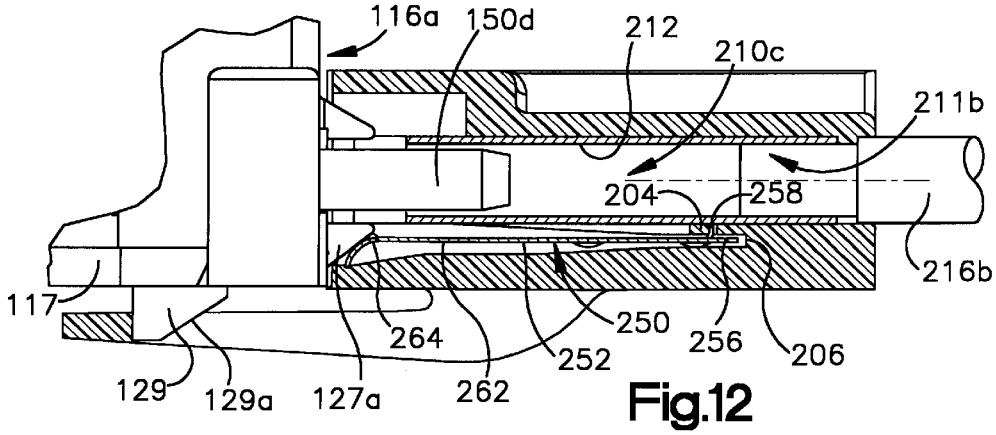
FIG. 12 is the sectional view of FIG. 11 after engagement of the connector housing and the switch assembly housing.
Figure 15:
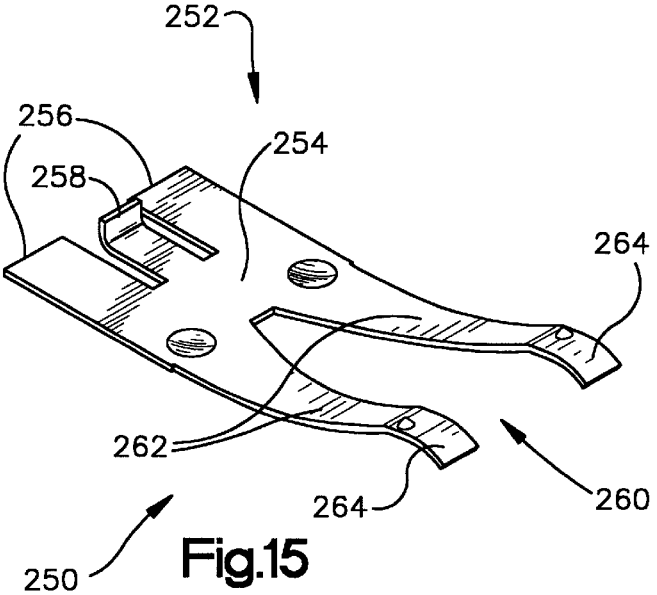
FIG. 15 is a perspective view of a shorting member of the connector assembly.

As can be seen in FIGS. 11 and 12, a shorting member 250 is positioned to electrically couple or short circuit the center two of the female socket assemblies 210*b*, 210*c* when the connector housing 202 is disengaged from the switch housing 112. The shorting member 250 is comprised of a flexible very thin strip (approximately 0.009 inch thick) of phosphor bronze (an alloy of tin, copper and phosphorus). The shorting member 250 is supported in a rectangular opening in the connector housing 202. As can best be seen in FIG. 15, the shorting member 250 includes a central support portion 252 and a contacting portion 260. The support portion 252 is configured to secure the shorting member 252 in place within the connector housing 202 and the contacting portion 260 includes two parallel, spaced apart forwardly extending arms 262 extending forwardly from opposite edges of a central body 254 of the support portion 252. The support portion 252 includes two parallel, spaced apart arms 256 extending rearwardly from the central body 254 and an upwardly angled protruding section 258.

Each of the forwardly extending arms 262 include arcuate distal portions 264 which contact an exterior surface of respective sockets 212 of the socket assemblies 210*b*, 210*c*. The shorting member 250 is prevented from moving forward horizontally with respect to the connector housing 202 by the angled protruding section 258 which engages a step 204 in the connector housing 202. The shorting member 250 is prevented from moving horizontally rearward with respect to the connector housing 202 because the rearwardly extending arms 256 fit tightly into narrow slits 206 in the connector housing 202. When the connector housing 202 is disengaged from the switch housing 112, the arcuate portions 264 of the forwardly extending arms 262 contact the sockets 212 of the socket assemblies 210*b*, 210*c* thereby electrically connecting the two center leads 216*b* and 216*c*. This is the same electrical result as occurs if the actuator 130 is in its first position, i.e., the inner terminal 150, 152 are electrically connected or bridged and thus the two center leads 216*b*, 216*c* are electrically connected (or shorted). This prevents an operator from bypassing or defeating the safety cut off function provided by the normally closed inner terminal set 150, 152 by simply disconnecting the connector 202 housing from the switch housing 112. Of course, it should be recognized by those skilled in the art that a properly configured shorting member could be used to similarly short the outer terminals 160, 162 but that a shorting member is only necessary where the terminal are normally closed (like inner terminals 150, 152). Of course, depending on functional requirements either pair of terminals can be designed to be normally open or normally closed by proper orientation of the contacts 137*a*, 137*b* on the actuator 130 (as explained above) and by having or not having properly sized openings in the contact portions 150*a*, 152*a*, 160*a*, 162*a* of the terminals 150, 152, 160, 162.

As can best be seen in FIG. 12, when the connector housing 202 is engaged with the switch housing 112, the beveled edges of the triangular nubs 127*a*, 127*b* extending outwardly from the forward edge of the bottom cover 117 contact and deflect downwardly the arcuate portions 264 of the forwardly extending arms 262 thereby permitting electrically connection or nonconnection between the socket assemblies 210*b*, 210*c* to be determined by the position of the actuator 130, i.e., when the actuator 130 is in its first, undepressed position, the socket assemblies 210*b*, 210*c*, and the conductive leads 216*b*, 216*c* are electrically connected and when the actuator 130 is in its second, depressed position, the socket assemblies 210*b*, 210*c*, and the conductive leads 216*b*, 216*c* are not electrically connected.

Figures 3, 4:
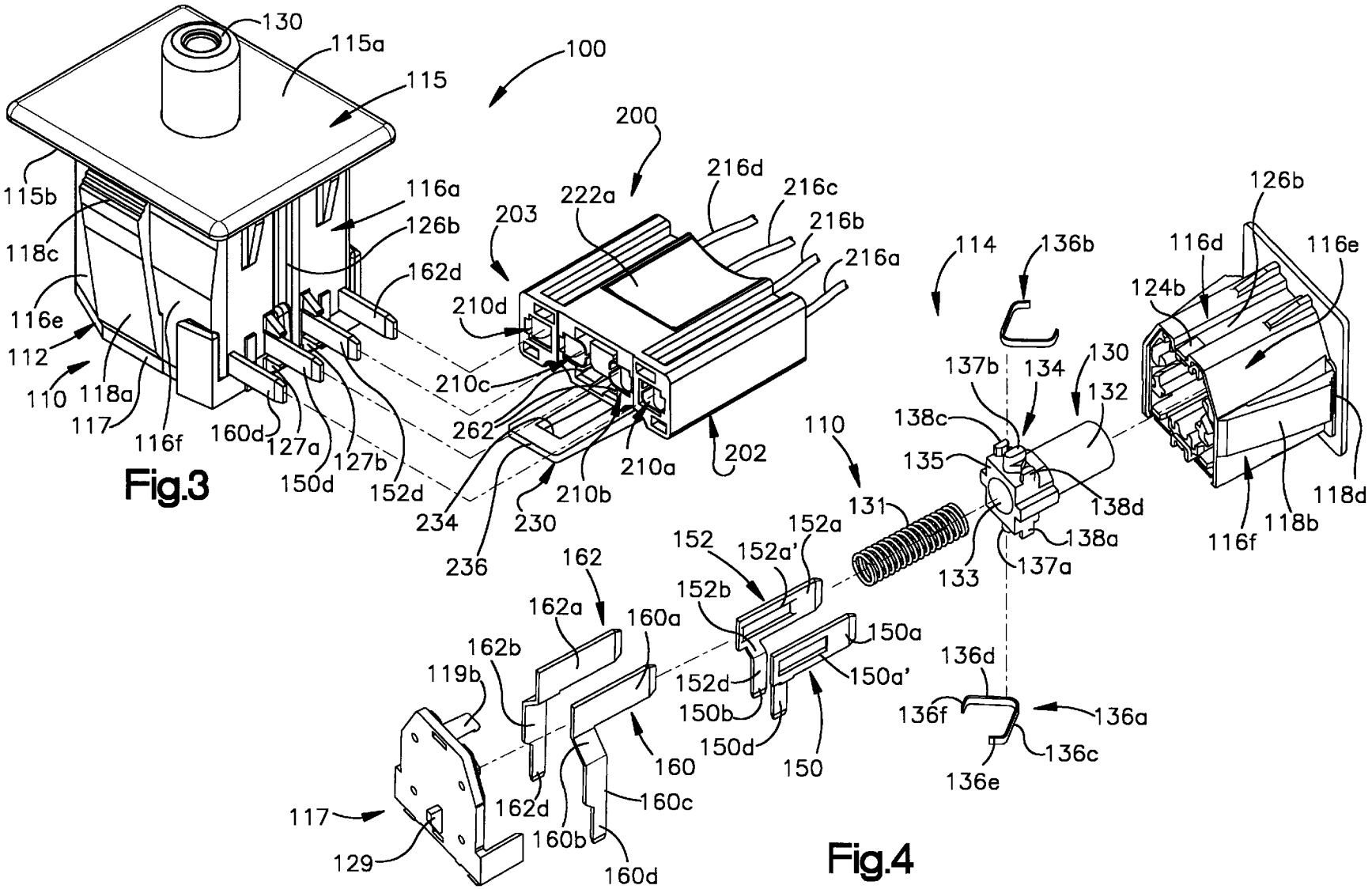
FIG. 3 is a perspective view the switch assembly housing and connector assembly housing disengaged.
FIG. 4 is an exploded perspective view of the switch assembly.

As can best be seen in FIGS. 3, 11 and 12, the bottom wall 222*b* of the connector housing includes a U-shaped flexible arm 230 extending downwardly and beyond the front wall 224*a* of the connector housing. The flexible arm 230 defines a rectangular opening 234 sized to receive a beveled rectangular nub 129 extending downwardly from a bottom surface 121*b* of the connector housing 117. To engage the connector housing 202 and the switch housing 112, the connector housing 202 is aligned with the switch housing 112 such that the terminal exterior portions 150*d*, 152*d*, 160*d*, 162*d* are aligned with the socket assemblies 210*a*, 210*b*, 210*c*, 210*d*. The front wall 224*a* of the connector housing 202 is then moved to contact the front wall 116*a* of the switch housing 112. Initially, a distal end 236 of the flexible arm 230 contacts the beveled forwardly facing edge 129*a* of the rectangular nub 129 and is deflected downwardly. When the connector housing front wall 224*a* is flush with the switch housing front wall 116*a*, the nub 129 is aligned with a front portion of the rectangular opening 234 of the flexible arm 230 and deflects upwardly capturing the nub 129 in the opening 234 as shown in FIG. 12 thereby securing the engagement of the connector housing 202 and the switch housing 112. To disengage the connector housing 202 from the switch housing 112, pressure is applied to the distal end 236 of the extending flexible arm 230 to deflect it downwardly sufficiently so that the nub 129 is free of the rectangular opening 234, then the connector housing 202 can be pulled away from the switch housing 112.

While the invention has been described herein in its currently preferred embodiment or embodiments, those skilled in the art will recognize that other modifications may be made without departing from the invention and it is intended to claim all modifications and variations as fall within the scope of the invention.

We claim:

1. A switch and connector assembly comprising:

a) a switch assembly including a switch housing defining an interior region and supporting switch components therein and an actuator extending through an opening in a wall of the switch housing and being moveable with respect to the switch housing between a first position and a second position, the switch housing having an exteriorly extending extension member;

b) the switch components including a first conductor supported within the switch housing interior region and moveable with the actuator along a path of travel to selectively bridge first and second terminals of a first set of terminals supported by the housing in a spaced apart relationship, the first and second terminals in the first set of the terminals each having an extending portion extending externally through the switch housing transverse to a direction of movement of the actuator, the first conductor electrically coupling the first and second terminals of the first set of terminals in one of the first and second positions of the actuator;

c) a connector assembly including a connector housing releasably engaging the switch housing, the connector assembly including first and second terminals of a first set of terminals supported by the connector housing in a spaced apart relationship and oriented to electrically contact the first and second terminals of the first set of terminals of the switch assembly when the connector housing and switch housing are engaged; and d) a conductive shorting member supported in the connector housing and biased to contact and electrically couple the first and second terminals of the first set of terminals of the connector assembly upon disengagement of the connector housing and the switch housing, the switch housing extension member contacting and deflecting a contacting portion of the shorting member away from contact with at least one of the first and second terminals of the first set of terminals of the connector assembly thereby breaking the electrical coupling between the first and second terminals of the first set of terminals of the connector assembly upon engagement of the connector housing and the switch housing.

2. The switch and connector assembly of claim 1 wherein the switch components further include a second conductor supported within the switch housing interior region and moveable with the actuator along a path of travel to selectively bridge first and second terminals of a second set of terminals supported by the housing in a spaced apart relationship, the first and second terminals in the second set of the terminals each having an extending portion extending externally through the switch housing transverse to a direction of movement of the actuator, the second conductor electrically coupling the first and second terminals of the second set of terminals in one of the first and second positions of the actuator and wherein the connector assembly further includes first and second terminals of a second set of terminals supported by the connector housing in a spaced apart relationship and oriented to contact and electrically couple the first and second terminals of the second set of terminals of the switch assembly when the connector housing and switch housing are engaged.

3. The switch and connector assembly of claim 2 wherein the extending portion of the first and second terminals of the first set of terminals and the first and second terminals of the second set of terminals extends through a side wall of the switch housing and is substantially perpendicular to a direction of movement of the actuator.

4. The switch and connector assembly of claim 2 wherein the terminals of the connector assembly are in linear alignment and the first and second terminals of the first set of terminals of the connector assembly are located between the first and second terminals of the second set of terminals of the connector assembly.

5. The switch and connector assembly of claim 2 wherein the first and second conductors are V-shaped and are supported at opposite ends of a boss extending from a bottom portion of the actuator.

6. The switch and connector assembly of claim 2 wherein the first conductor electrically couples the first and second terminals of the first set of terminals of the switch assembly in the first position of the actuator and the second conductor electrically couples the first and second terminals of the second set of terminals in the second position of the actuator, and the first and second terminals of the first set of terminals are located between and substantially parallel to the first and second terminals of the second set of terminals.

7. The switch and connector assembly of claim 2 wherein the actuator is biased to the first position by a coil spring disposed within the switch housing interior region and extending between a bottom cover of the switch housing and the actuator.

8. The switch and connector assembly of claim 7 wherein the coil spring extends into an opening in a bottom portion of the actuator and a post extending upwardly from the bottom cover of the switch housing facilitates maintaining a stationary position of the coil spring with respect to the bottom cover.

9. The switch and connector assembly of claim 1 wherein the actuator is biased to the first position.

10. The switch and connector assembly of claim 1 wherein the actuator extends though an opening in an upper wall of the switch housing.

11. The switch and connector assembly of claim 1 wherein the conductive shorting member is comprised of phosphor bronze.

12. The switch and connector assembly of claim 1 wherein the shorting member is substantially flat and includes a mounting portion and the terminal contacting portion includes two spaced apart extending contacting arms, the shorting member mounted in the connector housing such that the contacting arms are biased to contact the first and second terminals of the first set of terminals of the connector assembly.

13. The switch and connector assembly of claim 12 wherein the switch housing extension member comprises two spaced apart triangular shaped protrusions extending from an exterior surface of the switch housing proximate to the extending portions of the first and second terminals of the first set of terminals of the switch assembly, the two protrusions each are positioned to align with a respective one of the two extending contacting arms of the shorting member such that when the switch housing and connector housing are engaged, the two protrusions each contact and deflect a respective one of the extending contacting arms away from contact with the first and second terminals of the first set of terminals of the connector assembly.

14. It The switch and connector assembly of claim 1 wherein the switch housing includes a bottom cover that snap fits onto a lower portion of the switch housing to facilitate ultrasonic welding of the bottom cover to the switch housing.

15. The switch and connector assembly of claim 1 wherein the switch housing includes a top wall through which the actuator extends and a plurality of side walls extending downwardly from the top wall, the top wall extends outwardly beyond the plurality of side walls and a pair of flexible wings extend from a lower portion of two of the plurality of side walls toward top surface, the switch housing being mountable to a support having a cutout conforming in shape to a shape of the plurality of side walls of the switch housing, a peripheral region of the support surrounding the cutout being sandwiched between an upper surface of the flexible wings and a portion of a lower surface of the top wall extending outwardly beyond the plurality of side walls to secure the switch housing to the support.

16. The switch and connector assembly of claim 15 wherein the support is a seat pan of a garden tractor wherein the actuator extends above the seat pan and is depressed to the second position when a seat cushion supported by the seat pan is forced downwardly when an operator sits on the seat cushion.

17. A connector assembly configured for releasable engagement with a switch housing having first and second terminals including portions extending outwardly through a wall of the switch housing, the connector assembly comprising:

a) a connector housing;

b) first and second terminals of a first set of terminals supported by the connector housing in a spaced apart relationship and oriented to electrically contact the first and second terminals of the switch assembly when the connector housing and switch housing are engaged; and c) a conductive shorting member supported in the connector housing biased to contact and electrically couple the first and second terminals of the first set of terminals of the connector assembly upon disengagement of the connector housing and the switch housing, the conductive shorting member including a terminal contacting portion configured to contact and be deflected by the switch housing away from contact with at least one of the first and second terminals of the first set of terminals of the connector assembly thereby breaking the electrical coupling between the first and second terminals of the first set of terminals of the connector assembly upon engagement of the connector housing and the switch housing.

18. The connector assembly of claim 17 wherein the conductive shorting member is comprised of phosphor bronze.

19. The connector assembly of claim 17 wherein the shorting member is substantially flat and includes a mounting portion and the terminal contacting portion includes two spaced apart extending contacting arms, the shorting member mounted in the connector housing such that the contacting arms are biased to contact the first and second terminals of the first set of terminals of the connector assembly.

20. The connector assembly of claim 19 wherein the two spaced apart contacting arms are each configured to contact and be deflected by the switch housing away from contact with respective different ones of the first and second terminals of the first set of terminals of the connector assembly thereby breaking the electrical coupling between the first and second terminals of the first set of terminals of the connector assembly upon engagement of the connector housing and the switch housing.

21. The connector assembly of claim 17 further including first and second terminals of a second set of terminals of the connector assembly and further wherein first and second terminals of the first set of terminals and first and second terminals of the second set of terminals of the connector assembly are in linear alignment and the first and second terminals of the first set of terminals of the connector assembly are located between the first and second terminals of the second set of terminals of the connector assembly.

22. A switch assembly comprising:

a) a switch housing defining an interior region and supporting switch components therein and an actuator extending through an opening in a wall of the switch housing and being moveable with respect to the switch housing between a first position and a second position, the switch housing having an exteriorly extending extension member;

b) the switch components including first and second conductors supported within the switch housing interior region and moveable with the actuator along a path of travel to selectively bridge first and second sets of terminals supported by the housing in a spaced apart relationship, the first set of terminals including first and second terminals and the second set of terminals including first and second terminals, the first and second terminals in the first set of terminals and the first and second terminals in the second set of terminals each having an extending portion extending externally through the switch housing transverse to a direction of movement of the actuator, the first conductor electrically coupling the first and second terminals of the first set of terminals in one of the first and second positions of the actuator and the second conductor electrically coupling the first and second terminals of the second set of terminals in one of the first and second positions of the actuator;

c) the first and second conductors are V-shaped and are supported at opposite ends of a boss extending from a bottom portion of the actuator;

d) the first and second terminals of the first set of terminals are located between and substantially parallel to the first and second terminals of the second set of terminals; and e) vertically oriented guides of the actuator boss slide within vertical channels formed in a pair of vertical supports which extend inwardly from opposite side walls of the switch housing.

23. The switch assembly of claim 22 wherein the actuator boss additionally includes front and rear center posts, the front center post sliding within a front vertical channel in a front vertical support extending rearwardly from a front wall of the switch housing and the rear center post sliding within a rear vertical channel in a rear vertical support extending frontwardly from a back wall of the switch housing.

24. The switch assembly of claim 22 wherein the vertical supports extending inwardly from the opposite side walls of the switch housing each define forward edges which abut and help locate rearward portions of a respective one of the first and second terminals of the first set of terminals and further each define a recessed passageway through which a respective one of the first and second terminals of the second set of terminals extend.

25. The switch assembly of claim 22 wherein the front vertical support extending rearwardly from the front wall of the switch housing defines a pair of recessed passageways through which the first and second terminals of the first set of terminals respectively extend.

* * * * *